US008591005B2

(12) United States Patent
Nakamoto et al.

(10) Patent No.: US 8,591,005 B2
(45) Date of Patent: Nov. 26, 2013

(54) LIQUID EJECTION HEAD AND METHOD OF MANUFACTURING THE SAME

(75) Inventors: Hikaru Nakamoto, Inuyama (JP); Manabu Hibi, Nagoya (JP); Hidekazu Nogami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 165 days.

(21) Appl. No.: 13/249,021

(22) Filed: Sep. 29, 2011

(65) Prior Publication Data

US 2012/0086751 A1 Apr. 12, 2012

(30) Foreign Application Priority Data

Oct. 8, 2010 (JP) ..... 2010-228341

(51) Int. Cl.
*B41J 2/135* (2006.01)

(52) U.S. Cl.
USPC ..... 347/44; 347/20; 347/47

(58) Field of Classification Search
USPC ..... 347/20, 44, 47, 56, 61–65, 67
See application file for complete search history.

(56) References Cited

U.S. PATENT DOCUMENTS 6,260,272 B1 * 7/2001 Inose et al. ..... 347/47
2006/0152549 A1 7/2006 Asuke
2011/0242216 A1 10/2011 Nakamoto

FOREIGN PATENT DOCUMENTS

EP 0943441 A1 9/1999
JP 2006-264147 A 10/2006
JP 2006-334910 A 12/2006

OTHER PUBLICATIONS

European Patent Office; extended European Search Report for European Patent Application No. 11002315.7 (counterpart to above-captioned U.S. patent application), dated Jun. 7, 2011.

* cited by examiner

*Primary Examiner* — Juanita D Jackson
(74) *Attorney, Agent, or Firm* — Baker Botts L.L.P.

(57) ABSTRACT

A liquid ejection head, wherein recessed portions are formed in an ejection face such that, where, in the one direction, a distance D1 is a distance between (i) a one-side portion of an opening end of one recessed portion and (ii) an other-side portion of an opening end of another recessed portion adjacent to the one recessed portion on one side thereof and where a distance D2 is a distance between (i) an other-side portion of the opening end of the one recessed portion and (ii) a one-side portion of an opening end of another recessed portion adjacent to the one recessed portion on the other side thereof, a large-and-small relationship of an average value of the distances D1, D2 of a second recessed portion with respect to that of a first recessed portion is the same as a large-and-small relationship of a cross-sectional area of the first recessed portion with respect to that of the second recessed portion.

19 Claims, 10 Drawing Sheets

LIQUID EJECTION HEAD AND METHOD OF MANUFACTURING THE SAME

CROSS REFERENCE TO RELATED APPLICATION

The present application claims priority from Japanese Patent Application No. 2010-228341, which was filed on Oct. 8, 2010, the disclosure of which is herein incorporated by reference in its entirety.

BACKGROUND OF THE INVENTION

1. Field of the Invention

The present invention relates to a liquid ejection head configured to eject liquid such as ink and a method of manufacturing the head.

2. Description of the Related Art

There is conventionally known an ink-jet head as one example of a liquid ejection head in which an ink repellent layer is formed on an ejection face at peripheries of ejection openings of the ejection face in order to enhance ink ejection characteristics. However, the ink repellent layer may be damaged by a pressure of a wiper for wiping foreign matters off the ejection face. In order to protect the peripheries of the ejection openings on the ink repellent layer, there is a technique for forming recessed portions in the ejection face and forming ejection openings in a bottom portion of each of the recessed portions.

Where the above-described head is manufactured, after an ink-repellent-layer forming step for forming the ink repellent layer on the bottom portion of the recessed portion, an excess-portion removing step is performed for removing an excess portion of the ink repellent layer which has been formed in each ejection opening. For example, in the excess-portion removing step, cleaning, UV exposure, plasma exposure, and so on are performed in a state in which the ejection face is covered with a mask.

SUMMARY OF THE INVENTION

However, if the above-described techniques are employed, a variation may occur in pressures of components such as the wiper and the mask onto the ejection face due to shapes and arrangements of the recessed portion formed in the ejection face. The variation of the pressures causes the following problems. For example, where a pressure from the wiper is made equal to or higher than a predetermined value that is required for wiping foreign matters off the entire ejection face, an excessively high pressure may be applied to some areas of the ejection faces from the wiper, resulting in damage to portions of the ink repellent layer at peripheries of the ejection openings in each recessed portion. Further, it becomes difficult to adjust the pressure applied from the mask onto the ejection face such that the mask does not enter into the ejection openings. If the excess-portion removing step is performed in the state in which the mask has entered into the ejection openings, the excess portion cannot be reliably removed, leading to ejection failure.

This invention has been developed in view of the above-described situations, and it is an object of the present invention to provide: a liquid ejection head capable of reducing a variation of pressures from components such as a wiper and a mask onto an ejection face of the liquid ejection head; and a method of manufacturing the liquid ejection head.

The object indicated above may be achieved according to the present invention which provides a liquid ejection head, comprising: an ejection face having a plurality of recessed portions formed therein, wherein the plurality of the recessed portions include: a first recessed portion having a bottom portion in which at least one ejection opening is formed for ejecting liquid and on which a liquid repellent layer is formed; and a second recessed portion having an opening end whose length in one direction parallel to the ejection face is the same as a length of an opening end of the first recessed portion in the one direction, and wherein the plurality of the recessed portions are formed such that, where a distance D1 is a distance between (i) a one-side portion of an opening end of one recessed portion of the plurality of the recessed portions in the one direction and (ii) an other-side portion of an opening end of another recessed portion, in the one direction, adjacent to the one recessed portion on one side of the one recessed portion in the one direction without interposing any recessed portions between said another recessed portion and the one recessed portion and where a distance D2 is a distance between (i) an other side portion of the opening end of the one recessed portion in the one direction and (ii) a one-side portion of an opening end of another recessed portion, in the one direction, adjacent to the one recessed portion on the other side of the one recessed portion in the one direction without interposing any recessed portions between said another recessed portion and the one recessed portion, a large-and-small relationship of an average value of the distance D1 and the distance D2 of the second recessed portion with respect to an average value of the distance D1 and the distance D2 of the first recessed portion is the same as a large-and-small relationship of an area of a cross section of the first recessed portion which cross section is perpendicular to the ejection face and along the one direction, with respect to an area of a cross section of the second recessed portion which cross section is perpendicular to the ejection face and along the one direction.

The object indicated above may be achieved according to the present invention which provides a method of manufacturing a liquid ejection head having an ejection face that has a plurality of recessed portions formed therein, the method comprising: a recessed-portion forming step of forming the plurality of the recessed portions including: a first recessed portion having a bottom portion in which at least one ejection opening is formed for ejecting liquid; and a second recessed portion having an opening end whose length in one direction parallel to the ejection face is the same as a length of an opening end of the first recessed portion in the one direction; a liquid-repellent-layer forming step of forming a liquid repellent layer on the bottom portion of the formed first recessed portion; a masking step of covering, with a mask, a portion of the ejection face on which the liquid repellent layer is formed, the portion including the at least one ejection opening; an excess-portion removing step of removing an excess portion of the formed liquid repellent layer after the masking step, the excess portion being formed in the at least one ejection opening; and a mask removing step of removing the mask from the ejection face after the excess-portion removing step, wherein the recessed-portion forming step is a step of forming the plurality of the recessed portions such that, where a distance D1 is a distance between (i) a one-side portion of an opening end of one recessed portion of the plurality of the recessed portions in the one direction and (ii) an other-side portion of an opening end of another recessed portion, in the one direction, adjacent to the one recessed portion on one side of the one recessed portion in the one direction without interposing any recessed portions between said another recessed portion and the one recessed portion and where a distance D2 is a distance between (i) an other-side portion of the opening end of the one recessed portion in the one direction and (ii) a one-side portion of an opening end of another recessed portion, in the one direction, adjacent to the one recessed portion on the other side of the one recessed portion in the one direction without interposing any recessed portions between said another recessed portion and the one recessed portion, a large-and-small relationship of an average value of the distance D1 and the distance D2 of the second recessed portion with respect to an average value of the distance D1 and the distance D2 of the first recessed portion is the same as a large-and-small relationship of an area of a cross section of the first recessed portion which cross section is perpendicular to the ejection face and along the one direction, with respect to an area of a cross section of the second recessed portion which, cross section is perpendicular to the ejection face and along the one direction.

BRIEF DESCRIPTION OF THE DRAWINGS

The objects, features, advantages, and technical and industrial significance of the present invention will be better understood by reading the following detailed description of embodiments of the invention, when considered in connection with, the accompanying drawings, in which.

DETAILED DESCRIPTION OF THE EMBODIMENTS

Hereinafter, there will be described embodiments of the present invention by reference to the drawings.

Figure 1:
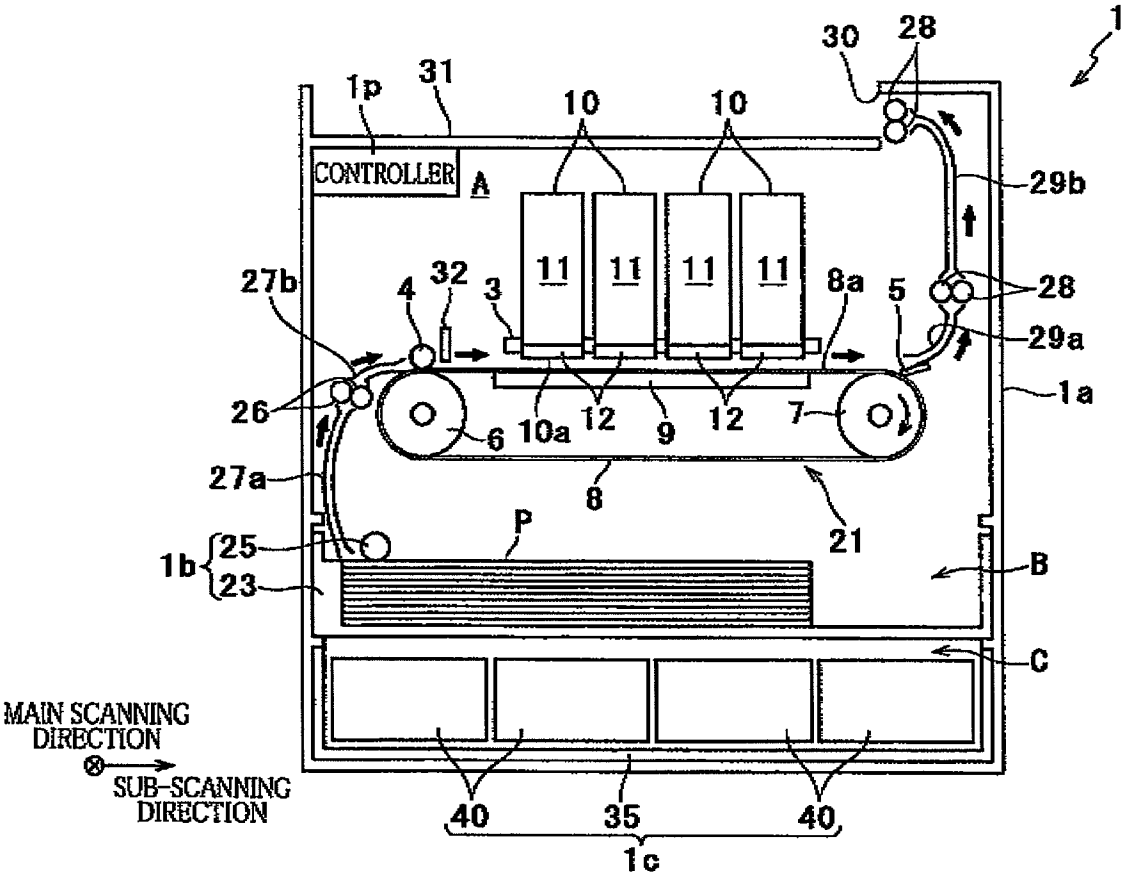
FIG. 1 is an external perspective view showing a side view generally showing an internal structure of an ink-jet printer including ink-jet heads each as a first embodiment of the present invention.

There will be initially explained, with reference to FIG. 1, an overall construction of an ink-jet printer 1 including ink-jet heads 10 each as a first embodiment of the present invention.

The printer 1 includes a casing 1*a* having a rectangular parallelepiped shape. A sheet-discharge portion 31 is provided on a top plate of the casing 1*a*. An inner space of the casing 1*a* is divided into spaces A, B, and C in order from above. The spaces A and B are spaces in which is formed a sheet conveyance path continuous to the sheet-discharge portion 31. In the space A, a sheet P is conveyed, and an image is recorded on the sheet P. In the space B, operations for supplying the sheet F are performed. In the space C, ink cartridges 40 are accommodated each as an ink supply source.

In the space A, there are arranged the four ink-jet heads 10, a conveyance unit 21 for conveying the sheet P, a guide unit (which will be described below) for guiding the sheet F, and so on. In an upper portion of the space A, there is disposed a controller 1*p* configured to control operations of components of the printer 1 to control an overall operation of the printer 1.

On the basis of image data supplied from an external device, the controller 1*p* is configured to control: preparatory operations for recording; supplying, conveying, and discharging operations for the sheet P; an ink ejecting operation synchronized with the conveyance of the sheet P; recovery and maintaining operations of ejection characteristics (maintenance operations); and so on for recording the image on the sheet P.

Each head 10 is a line head having a generally rectangular parallelepiped shape elongated in a main scanning direction. The four heads 10 are arranged in a sub-scanning direction at predetermined pitches and supported by the casing 1*a* via a head frame 3. The head 10 includes a channel unit 12, eight actuator units 17 (see FIG. 2), and a reservoir unit 11. In the image recording, the four heads 10 eject inks of respective four colors, namely, magenta, cyan, yellow, and black from lower faces (ejection faces 10*a*) of the respective heads 10. Specific construction of each head 10 will be explained later in detail.

As shown in FIG. 1, the conveyance unit 21 includes: belt rollers 6, 7; an endless conveyance belt 8 wound around the rollers 6, 7; a nip roller 4 and a peeling plate 5 disposed outside the conveyance belt 8; a platen 9 disposed inside the conveyance belt 8; and so on.

The belt roller 7 is a drive roller that is rotated in a clockwise direction in FIG. 1 by a conveyance motor, not shown. The rotation of the belt roller 7 causes the conveyance belt 8 to run or be rotated in a direction indicated by bold arrows in FIG. 1. The belt roller 6 is a driven roller that is rotated by the rotation of the conveyance belt 8 in the clockwise direction in FIG. 1. The nip roller 4 is disposed so as to be opposed to the belt roller 6 and presses the sheet P supplied and guided by an upstream guide portion (which will be described below), onto an outer circumferential face 8*a* of the conveyance belt 8. The peeling plate 5 is disposed so as to face the belt roller 7 and peels the sheet P from the outer circumferential face 8*a* to guide the sheet P to a downstream guide portion (which will be described below). The platen 9 is disposed so as to face the four heads 10 and supports an upper portion of the conveyance belt 8 from an inside thereof. As a result, a predetermined space suitable for the image recording is formed between the outer circumferential face 8*a* and the ejection faces 10*a* of the respective heads 10.

The guide unit includes the upstream guide portion and the downstream guide portion disposed with the conveyance unit 21 interposed therebetween. The upstream guide portion includes guides 27*a*, 27*b* and a pair of conveyance rollers 26 and connects a sheet-supply unit 1*b* (which will be described below) and the conveyance unit 21 to each other. The downstream guide portion includes guides 29*a*, 29*b* and conveyance rollers 28 and connects the conveyance unit 21 and the sheet-discharge portion 31 to each other.

In the space B is disposed the sheet-supply unit 1*b* including a sheet-supply tray 23 and a sheet-supply roller 25. The sheet-supply tray 23 is mountable on and removable from the casing 1*a*. The sheet-supply tray 23 has a box-like shape opening upward so as to accommodate various sizes of sheets P. The sheet-supply roller 25 supplies an uppermost one of the sheets P in the sheet-supply tray 23 to the upstream guide portion.

As described above, in the spaces A, B is formed the sheet conveyance path extending from the sheet-supply unit 1*b* to the sheet-discharge portion 31 via the conveyance unit 21. On the basis of a recording command, the controller 1*p* drives a plurality of motors such as a sheet-supply motor, not shown, for driving the sheet-supply roller 25, a conveyance motor, not shown, for the conveyance rollers of each of the upstream and downstream guide portions, the above-described sheet-conveyance motor, and the like. The sheet P supplied from the sheet-supply tray 23 is supplied to the conveyance unit 21 by the conveyance rollers 26. When the sheet P passes through positions just under the heads 10 in the sub-scanning direction, the heads 10 eject the inks of the respective four colors in, order from the respective ejection faces 10*a*, to record a color image on the sheet P. The ink ejection is performed on the basis of a detection signal outputted from a sheet sensor 32. The sheet P is then peeled by the peeling plate 5 and conveyed upward by the conveyance rollers 28. The sheet P is then discharged onto the sheet-discharge portion 31 through an opening 30.

Here, the sub-scanning direction is a direction parallel to the conveyance direction in which the sheet P is conveyed by the conveyance unit 21 and along a horizontal plane, and the main scanning direction is a direction perpendicular to the sub-scanning direction and along the horizontal plane.

In the space C, an ink unit 1*c* is disposed so as to be mountable on and removable from the casing 1*a*. The ink unit 1*c* includes a cartridge tray 35 and the four cartridges 40 accommodated in the tray 35 side by side. The inks stored in the respective cartridges 40 are supplied to the respective heads 10 via respective ink tubes, not shown.

There will be next explained the construction of each head 10 with reference to FIGS. 2-5 in detail. It is noted that, in FIG. 3, pressure chambers 16 and apertures 15 are illustrated by solid lines for easier understanding purposes though these elements are located under the actuator units 17 and thus should be illustrated by broken lines. It is further noted that, since the four heads 10 have the same construction, the following explanation will be given for one of the heads 10 for the sake of simplicity.

Figure 5:
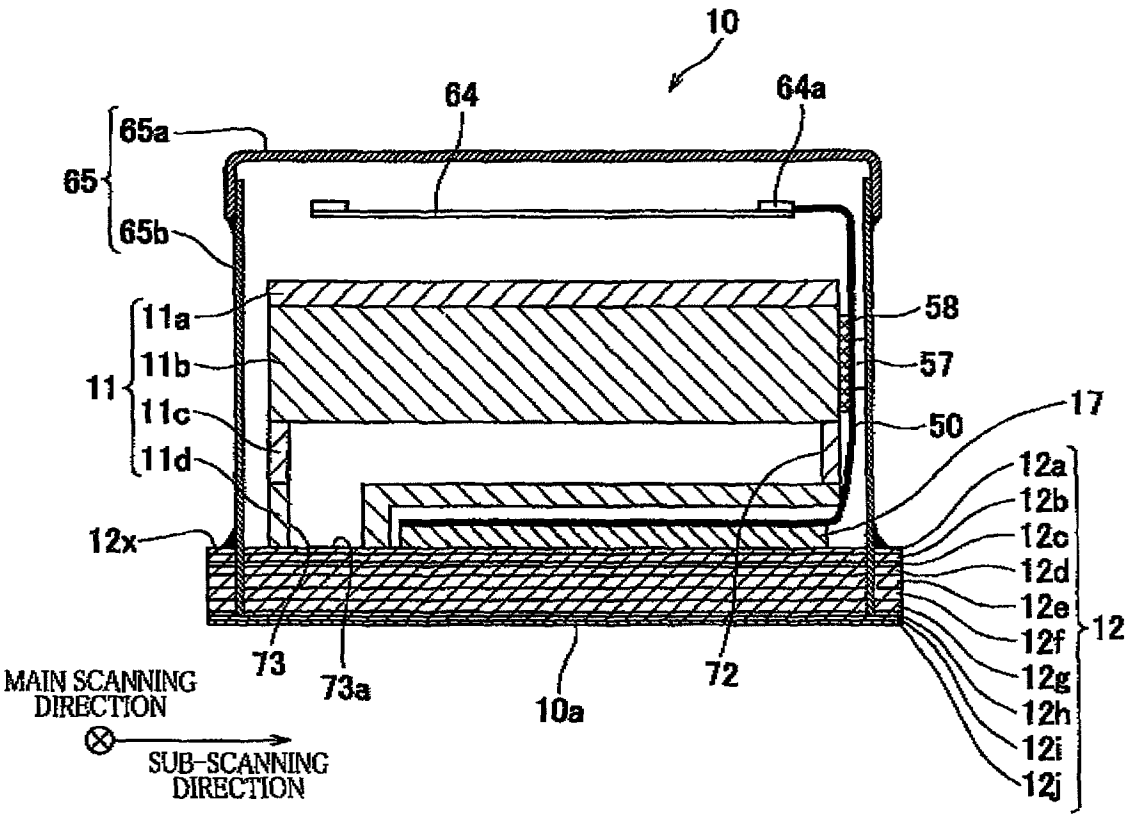
FIG. 5 is an elevational view in vertical cross section showing the ink-jet head.

As shown in FIG. 5, the head 10 is a stacked body in which the channel unit 12, the actuator units 17, the reservoir unit 11, and a printed circuit 64 are stacked on one another. The actuator units 17, the reservoir unit 11, and the printed circuit 64 are accommodated in a space defined by an upper face 12*x* of the channel unit 12 and a cover 65. In this space, Flexible Printed Circuits (FPCs) 50 electrically connect the respective actuator units 17 and the printed circuit 64. Driver ICs 57 are respectively mounted on the FPCs 50.

Each FPC 50 provided on a corresponding one of the actuator units 17 has wires respectively corresponding to electrodes of the actuator unit 17. The wirings are respectively connected to output terminals of the respective driver ICs 57. Under the control of the controller 1*p* (see FIG. 1), the FPC 50 sends the driver ICs 57 data adjusted by the printed circuit 64 and sends the electrodes of the actuator units 17 drive voltages generated by the driver ICs 57 via the wirings. The drive voltages are selectively applied to the respective electrodes.

As shown in FIG. 5, the cover 65 includes a top cover 65*a* and an aluminum side cover 65*b*. The cover 65 has a box shape opening downward and is fixed to the upper face 12*x* of the channel unit 12. The driver ICs 57 are held in contact with an inner face of the side cover 65*a* so as to be thermally connected to the cover 65*b*. It is noted that, in order for a reliable thermal connection, the driver ICs 57 are urged toward the side cover 65*a* by an elastic member 58 such as a sponge fixed to a side face of the reservoir unit 11.

The reservoir unit 11 is a stacked body constituted by four metal plates 11*a*-11*d* bonded to one another. In the reservoir unit ills formed an ink channel including a reservoir 72 for string the ink. The ink channel has: one end connected to the corresponding cartridge 40 via the corresponding tube; and the other end connected to the channel unit 12. As shown in FIG. 5, a projection and a recess are formed on and in a lower face of the plate 11*d* such that the recess forms a space between the plate lid and the upper face 12*x*. Each actuator unit 17 is fixed to the upper face 12*x* in the space, with a small clearance formed over the corresponding FPC 50. The plate lid has an ink outlet channel 73 formed therein. The ink outlet channel 73 is opened in a distal end face of the projection formed on the lower face of the plate 11*d*, that is, the ink outlet channel 73 is opened in a face of the plate 11*d* which is bonded to the upper face 12*x*.

The channel unit 12 has nine metal rectangular plates 12*a*-12*i* (see FIG. 4) having generally the same size and bonded to one another and a nickel plated layer 12*j*. The plate 12*i* has through holes (nozzles) formed therein each having a conical trapezoid shape. Distal ends of the respective nozzles function as ejection openings 144 from which the ink is ejected, and these ejection openings 14*a* open in a lower face of the plate 12*i* (i.e., one of opposite faces thereof farther from the plate 12*h*). The plated layer 12*j* is formed over the generally entire lower face of the plate 12*i* (specifically, an area of the lower face other than the ejection openings 14*a* and vicinities thereof).

Figure 2:
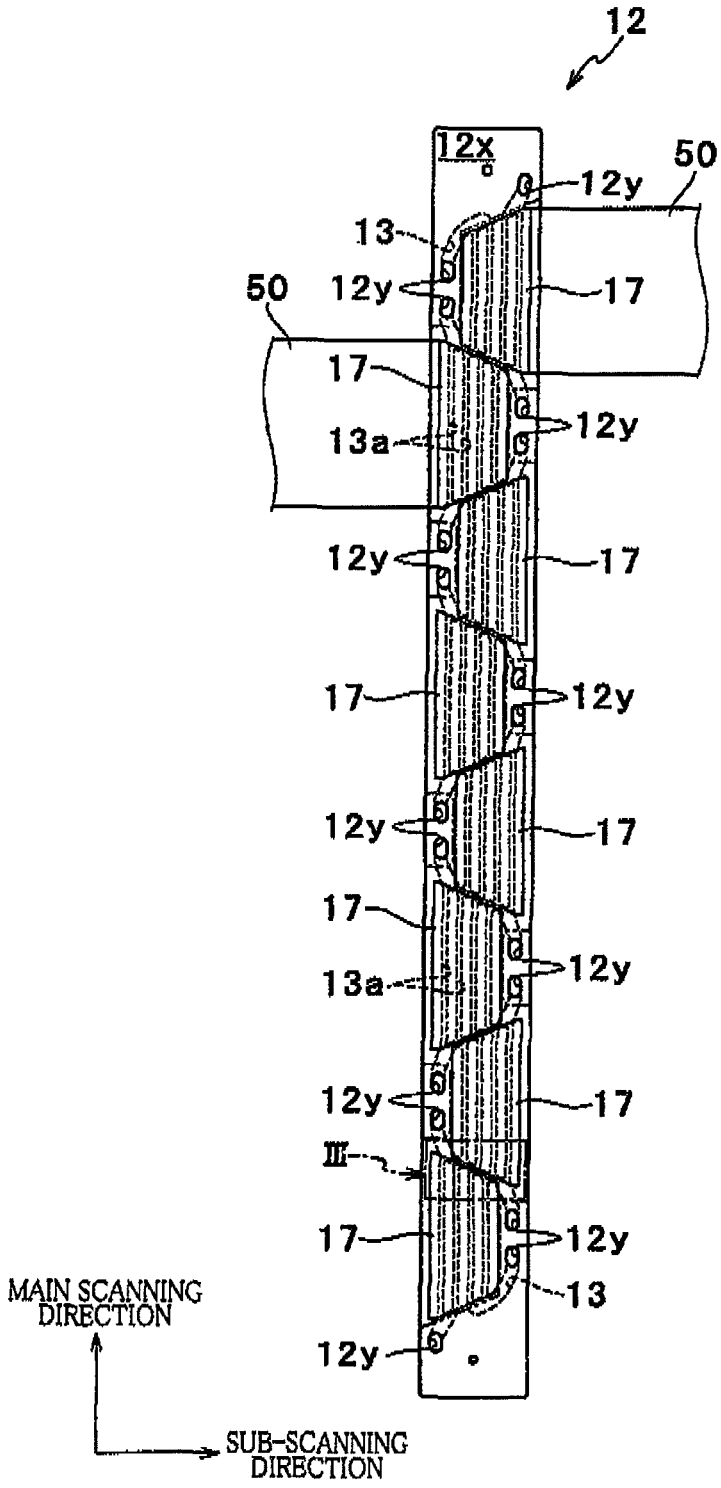
FIG. 2 is a plan view showing a channel unit and actuator units of the ink-jet head.
Figure 3:
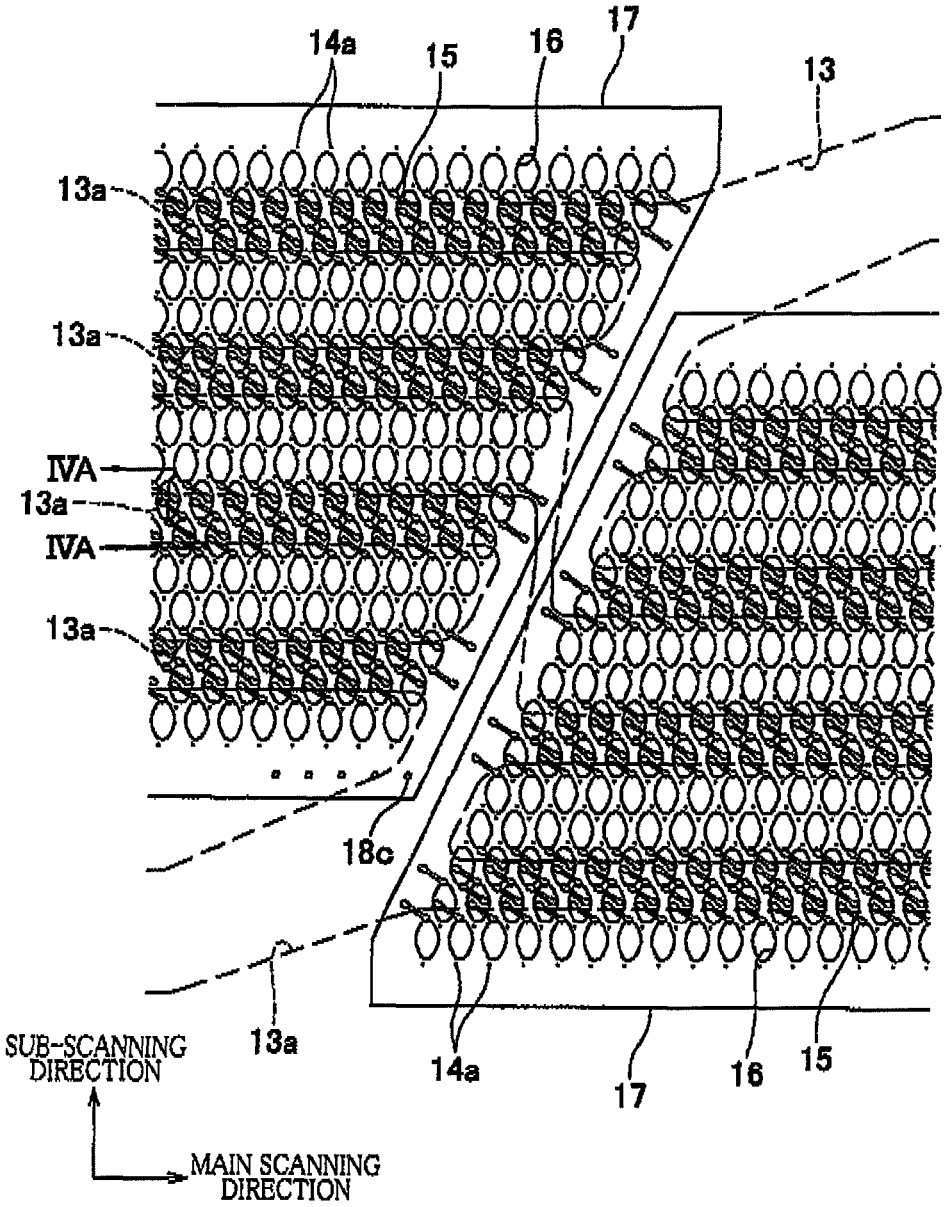
FIG. 3 is an enlarged view showing an area III enclosed with a one-dot chain line in FIG. 2.

As shown in FIG. 2, openings 12*y* are formed in the upper face 12*x* of the channel unit 12 so as to be respectively connected to openings 73*a* of the ink outlet channel 73. In the channel unit 12, there are formed ink channels each from one of the openings 12*y* to one of ejection openings 14*a*. As shown in FIGS. 2, 3, and 4, the ink channels include (a) manifold channels 13 respectively having the openings 12*y* at respective one ends, (b) sub-manifold channels 13*a* each branched from a corresponding one of the manifold channels 13, and (c) individual channels 14 each extending from an outlet of a corresponding one of the sub-manifold channels 13*a* to a corresponding one of the ejection openings 14*a* via a corresponding one of the pressure chambers 16.

Figure 4A:
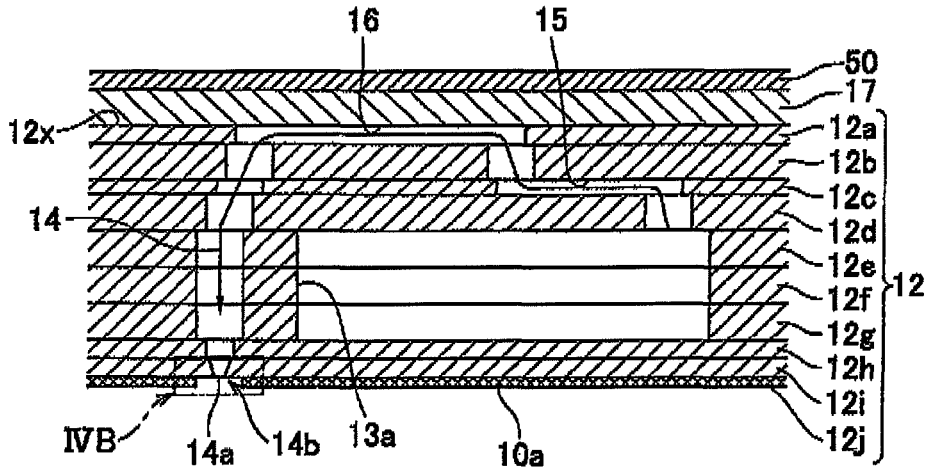
FIG. 4A is a partial cross-sectional view taken along line IVA-IVA in FIG. 3.

As shown in FIG. 4A, the individual channel 14 is formed for each ejection opening 14*a* so as to have (a) the aperture 15 functioning as a restrictor for adjusting a channel resistance and (b) a pressure chamber 16 opened in the upper face 12*x*. As shown in FIG. 3, each pressure chamber 16 has a generally rhombic shape, and the pressure chambers 16 are arranged in the upper face 12*x* in matrix so as to form eight pressure chamber groups each having a generally trapezoid shape in plan view. Each of the pressure chamber groups is constituted by sixteen pressure-chamber rows extending in the main scanning direction. The numbers of the pressure chambers included in pressure-chamber rows decrease from a longer side toward a shorter side of parallel sides of the trapezoid shape. Likewise, the ejection openings 14*a* are arranged in the ejection face 10*a* in matrix so as to form eight ejection opening groups each having a generally trapezoid shape in plan view. Each ejection opening group is constituted by sixteen ejection-opening rows extending in the main scanning direction.

Figure 4B:
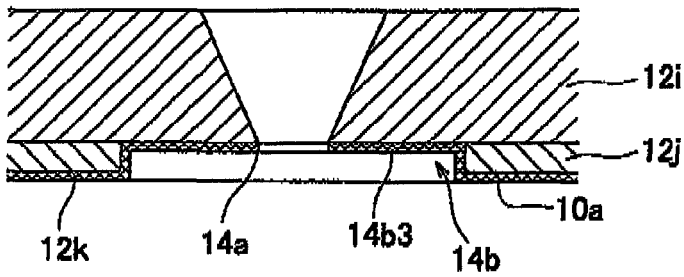
FIG. 4B is an enlarged view showing an area IVB enclosed with a one-dot chain line.
Figure 6:
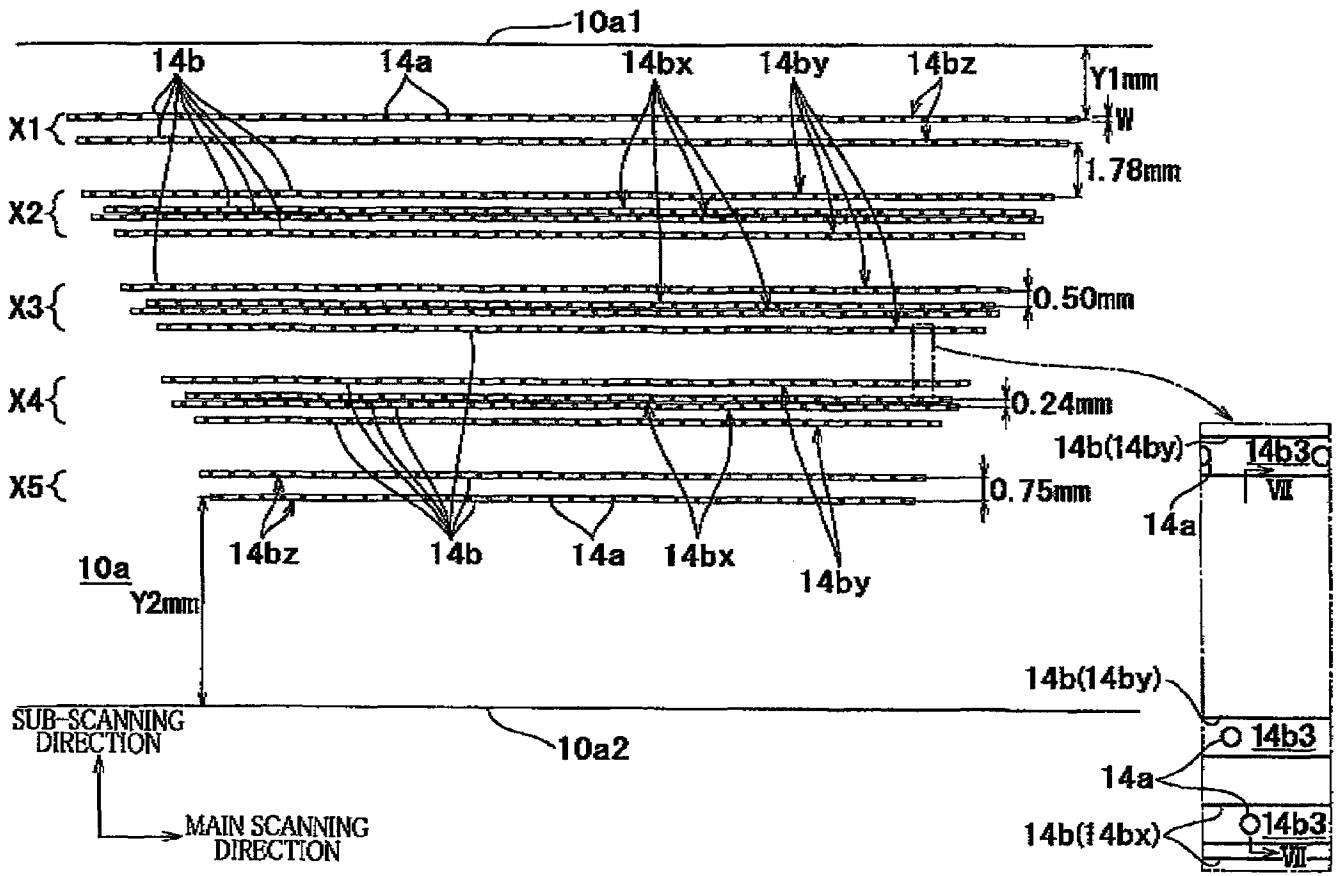
FIG. 6 is an enlarged view partially showing an ejection face of the ink-jet head.

As shown in FIG. 6, a plurality of recessed portions 14*b* are respectively formed in the ejection face 10*a* (i.e., the lower face of the plated layer 12*j*) at positions at which the ejection-opening rows are formed. As shown in FIG. 4B, each of the recessed portions 14*b* is a space defined by the plate 12*i* and the plated layer 12*j*. The areas of the plate 12*i* near the ejection openings 14*a* are exposed from the respective through holes of the plated layer 12*j*. A bottom portion 14*b*3 of each recessed portion 14*b* is constituted by a corresponding portion of the lower face of the plate 12*i*, and a side face of each recessed portion 14*b* (i.e., a portion of the plated layer 12*j* for defining side portions of the recessed portion 14*b*) is constituted by a side wall face of the plated layer 12*j* for defining the through hole formed therein. An ink repellent layer 12*k* is provided on an entirety of the ejection face 10*a* including the bottom portions 14*b*3 of the recessed portions 14*b* (except the ejection openings 14*a*). A thickness of the plated layer 12*j* (i.e., a depth of each recessed portion 14*b*) is generally 2 μm. The recessed portions 14*b* will be described below in more detail with reference to FIGS. 6 and 7.

As shown in FIG. 2, the actuator units 17 each having a trapezoid shape in plan view and are arranged on the upper face 12*x* in two arrays in a staggered configuration. As shown in FIG. 3, each of the actuator units 17 is disposed on an area corresponding to the trapezoid shape of a corresponding one of the pressure chamber groups (the ejection opening groups). Each actuator unit 17 has unimorph piezoelectric actuators each for a corresponding one of the pressure chambers 16. The actuators can be deformed independently of one another. When the drive voltage is applied to the actuator unit 17 from the FPC 50, the piezoelectric actuator deformed to change the volume of the pressure chambers 16, thereby applying an energy to the ink in the pressure chambers 16.

There will be next explained specific constructions of the recessed portions 14*b* with reference to FIG. 6.

As shown in FIG. 6, the sixteen recessed portions 14*b* are formed in the ejection face 10*a* so as to be arranged in an area corresponding to the actuator unit 17, and each of the recessed portions 14*b* is formed so as to correspond to one of the ejection opening groups. The recessed portions 14*b* each elongated in the main scanning direction (i.e., in a longitudinal direction of the channel unit 12) are distant from one another in the sub-scanning direction (i.e., in a widthwise direction of the channel unit 12). Lengths of the respective recessed portions 14*b* in the main scanning direction decrease in order from the lower side toward the upper side of the parallel sides of the trapezoid shape so as to correspond to the trapezoid shape formed by the ejection opening group. Widths W of the respective recessed portions 14*b* (i.e., a length or distance between opposite ends of each opening in the sub-scanning direction) are the same as one another (generally 0.1 mm).

The sixteen recessed portions 14*b* can be divided into two first groups and three second groups from a viewpoint of arrangements of the recessed portions 14*b*. Each first group is constituted by corresponding two of the recessed portions 14*b*, and each second group is constituted by corresponding four of the recessed portions 14*b*. In the present embodiment, in order from an upper side in FIG. 6, there are arranged a single recessed-portion group X1 as one of the first groups, three recessed-portion groups X2, X3, X4 as the second groups, and a single recessed-portion group X5 as the other first group. That is, the three second groups are interposed between the two first groups in the sub-scanning direction. Each of the recessed-portion groups X2-X4 has (a) two recessed portions (as examples of first recessed portions) 14*bx* adjacent to each other at the shortest distance in the sub-scanning direction among the recessed portions 14*b*, and (b) two recessed portions (as examples of second recessed portions) 14*by* interposing the two recessed portions 14*bx* therebetween from opposite sides thereof in the sub-scanning direction. A distance between the recessed portion 14*bx* and the recessed portion 14*by* adjacent thereto is the second shortest in the sub-scanning direction among the recessed portions 14*b*. Each of the recessed-portion groups X1 has two recessed portions 14*bz*. A distance between the two recessed portions 14*bz* constituting the first group is greater than the distance between the recessed portion 14*bx* and the recessed portion 14*by*.

In other words, the recessed portions 14*b* are divided into three groups (the recessed portions 14*bx*, 14*by*, 14*bz*) according to the distance of two recessed portions 14*b* arranged side by side in the sub-scanning direction. Each first group includes corresponding two of the recessed portions 14*bz*, each second group includes corresponding two of the recessed portions 14*bx* and corresponding two of the recessed portions 14*by*.

The plurality of the ejection openings 14*a* are opened in each bottom portion 14*b*3. A distance between centers of each adjacent two ejection openings 14*a* formed in the bottom portion 14*b*3 in the main scanning direction is constant. That is, the ejection openings 14*a* are arranged in the bottom portions 14*b*3 in the main scanning direction at regular intervals. It is noted that a distance between centers of any adjacent two ejection openings 14*a* in the sub-scanning direction may be hereinafter referred to as "a center-to-center distance between the two ejection openings 14*a*".

The ejection openings 14*a* are formed such that a center of opposite ends (upper and lower sides in FIG. 6) of each recessed portion 14*b* in the sub-scanning direction coincides with a center O (see FIG. 7) of a corresponding one of the ejection openings 14*a* formed in the recessed portion 14*b*. That is, in each recessed portion 14*b*, the plurality of the ejection openings 14*a* are arranged in a row along a line extending in the main scanning direction so as to pass through the center of the opposite ends of each recessed portion 14*b*.

In the present embodiment, the center-to-center distance between each two ejection openings 14*a* in the sub-scanning direction is set as shown in FIG. 6. Specifically, in each first group, a center-to-center distance in the sub-scanning direction between the two ejection openings 14*a* formed in the respective two recessed portions 14*bz* is 0.75 mm. In each second group, a center-to-center distance between the two ejection openings 14*a* formed in the respective two recessed portions 14*bx* in the sub-scanning direction is 0.24 mm, and a center-to-center distance in the sub-scanning direction between the ejection opening 14*a* formed in the recessed portion 14*bx* and the ejection opening 14*a* formed in the recessed portion 14*by* adjacent to the recessed portion 14*bx* is 0.50 mm. Among the recessed portion groups, a center-to-center distance in the sub-scanning direction between the two ejection openings 14*a* formed in the two recessed portions 14*b* adjacent to each other without interposing any other recessed portions 14*b* therebetween is 1.78 mm. For example, a center-to-center distance in the sub-scanning direction between the recessed portion 14*bz* of the recessed-portion group X1 and the recessed portion 14*by* of the recessed-portion group X2 is 1.78 mm.

Because of the staggered configuration, each of the ejection opening groups is offset toward one or the other side of the ejection face 104 with respect to the ejection face 10*a* in the sub-scanning direction. In the ejection opening group shown in FIG. 6, a distance between (a) the lower side of the trapezoid shape for partly defining an area of the ejection opening group and (b) one end portion (edge) 10*a*1 of the ejection face 10*a* is less than a distance between the upper side of the trapezoid shape and the other end portion (edge) 10*a*2 of the ejection face 10*a*. That is, the ejection opening group is offset toward one side of the ejection face 10*a* in the sub-scanning direction. A distance Y1 (mm) between the end portion 10*a*1 and the center of the ejection opening 14*a* located at the nearest position to the end portion 10*a*1 in the sub-scanning direction is greater than 1.78 mm and less a distance Y2 (mm) between the end portion 10*a*2 and the center of the ejection opening 14*a* located at the nearest position to the end portion 10*a*2 in the sub-scanning direction (1.78<Y1<Y2).

There will be next explained, with reference to FIG. 7, a specific construction of a cross section of the recessed portion 14*b* (a cross section perpendicular to the ejection face 10*a* and along the sub-scanning direction, and "cross section" appearing in the following explanation means the same). It is noted that the following explanation is provided, taking as examples the recessed portion 14*bx* located at a second position from a right side among the recessed portions in FIG. 7 and the recessed portion 14*by* located at a third position from the right side among the recessed portions in FIG. 7, but the following explanation can be applied to all the recessed portions 14*b*. Here, where an explanation is given with the recessed portion 14*bx* located at the second position from a right side among the recessed portions in FIG. 7 as a reference recessed portion, recessed portions 14*bx*, 14*by* interposing this recessed portion 14*bx* (the reference recessed portion) are respectively referred to as "other-side recessed portion" and "one-side recessed portion". That is, the recessed portion 14*y* located at the third position from the right side among the recessed portions in FIG. 7 is set as the one-side recessed portion, the recessed portion 14*bx* located at the second position from the right side among the recessed portions is set as the reference recessed portion, and the rightmost recessed portion 14*bx* among the recessed portions is set as the other-side recessed portion.

The recessed portion 14*bx* (the reference recessed portion) is next to the recessed portion 14*by* (the one-side recessed portion) on the one side (a left side in FIG. 7) of the recessed portion 14*bx* (the reference recessed portion) and next to the recessed portion 14*bx* (the other-side recessed portion) on the other side (the right side in FIG. 7) of the recessed portion 14*bx* (the reference recessed portion0) without interposing any other recessed portions 14*b* in the sub-scanning direction. Here, a distance in the sub-scanning direction between (a) a one-side opening end 14*b*1 (as one example of a one-side portion of an opening end) of the recessed portion 14*bx* (the reference recessed portion) and (b) the other-side opening end 14*b*2 (as one example of an other-side portion of an opening end) of the recessed portion 14*by* (the one-side recessed portion) adjacent to the recessed portion 14*bx* (the reference recessed portion) on the one side without interposing any other recessed portions 14*b* therebetween is set as D1. Further, a distance in the sub-scanning direction between (a) the other-side opening end 14*b*2 of the recessed portion 14*bx* (the reference recessed portion) and (b) the one-side opening end 14*b*1 of the recessed portion 14*bx* (the other-side recessed portion) adjacent to the recessed portion 14*bx* (the reference recessed portion) on the other side without interposing any other recessed portions 14*b* therebetween is set as D2.

Figure 7:
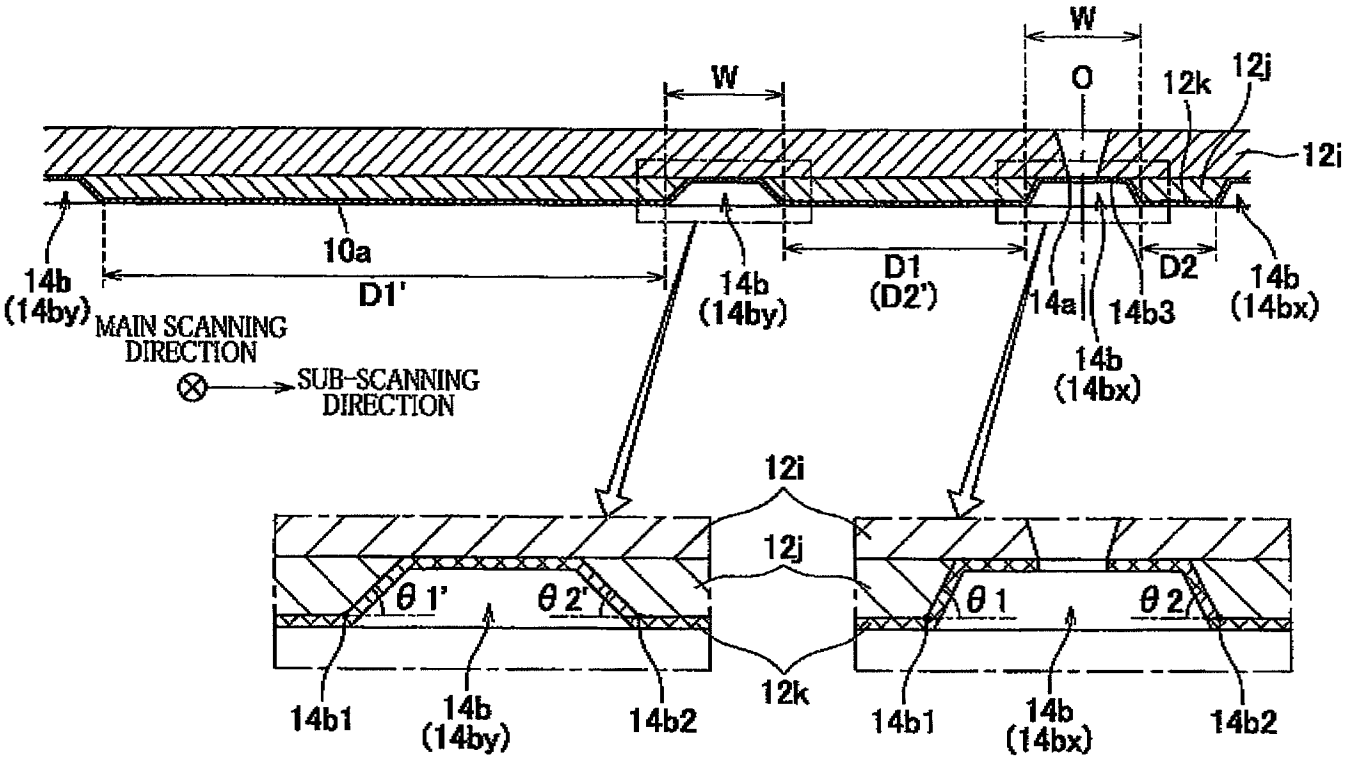
FIG. 7 is a partial cross-sectional view taken along line VII-VII in FIG. 6.

Further, where an explanation is given with the recessed portion 14*by* located at the third position from the right side among the recessed portions in FIG. 7 as a reference recessed portion, recessed portions 14*bx*, 14*by* interposing this recessed portion 14*by* (the reference recessed portion) are respectively referred to as "other-side recessed portion" and "one-side recessed portion". That is, the recessed portion 14*y* located at the fourth position from the right side among the recessed portions in FIG. 7 is set as the one-side recessed portion, the recessed portion 14*by* located at the third position from the right side among the recessed portions is set as the reference recessed portion, and the recessed portion 14*bx* located at the second position from the right side among the recessed portions is set as the other-side recessed portion. The recessed portion 14*by* (the reference recessed portion) is next to the recessed portion 14*by* (the one-side recessed portion) on the one side (a left side in FIG. 7) of the recessed portion 14*by* (the reference recessed portion) and next to the recessed portion 14*bx* (the other-side recessed portion) on the other side (the right side in FIG. 7) of the recessed portion 14*by* (the reference recessed portion) without interposing any other recessed portions 14*b* in the sub-scanning direction. Here, a distance in the sub-scanning direction between (a) a one-side opening end 14*b*1 (as one example of a one-side portion of an opening end) of the recessed portion 14*by* (the reference recessed portion) and (b) the other-side opening end 14*b*2 (as one example of an other-side portion of an opening end) of the recessed portion 14*by* (the one-side recessed portion) adjacent to the recessed portion 14*by* (the reference recessed portion) on the one side without interposing any other recessed portions 14*b* therebetween is set as D1'. Further, a distance in the sub-scanning direction between (a) the other-side opening end 14*b*2 (as one example of an other-side portion of the opening end) of the recessed portion 14*by* (the reference recessed portion) and (b) the one-side opening end 14*b*1 (as one example of a one-side portion of an opening end) of the recessed portion 14*bx* (the other-side recessed portion) adjacent to the recessed portion 14*by* (the reference recessed portion) on the other side without interposing any other recessed portions 14*b* therebetween is set as D2'.

In FIG. 7, a relationship of the distances is as follows: D2<D1=D2'<D1'.

It is noted that, where there is no recessed portion 14*b* on one of the one side and the other side of the recessed portion 14*b* in the sub-scanning direction (for example, in a case of the outermost recessed portion 14*bz* in the sub-scanning direction among the recessed portions 14*b*), a distance between the one-side opening end 14*b*1 or the other-side opening end 14*b*2 of the recessed portion 14*b* and the end portion 10*a*1 or 10*a*2 of the ejection face 10*a* is set as D1 (D1') or D2 (D2).

The plurality of the recessed portions 14*b* are formed such that a value relationship (a large-and-small relationship) of an average value of the distances D1', D2' of the recessed portion 14*by* with respect to an average value of the distances D1, D2 of the recessed portion 14*bx* is the same as a relationship (a large-and-small relationship) of an area of a cross section or a cross-sectional area (perpendicular to the ejection face 10*a* and along the sub-scanning direction, and "cross-sectional area" appearing in the following explanation means the same) of the recessed portion 14*bx* with respect to a cross-sectional area of the recessed portion 14*by*. Here, the distances D1, D2 of the recessed portion 14*bx* are distances D1, D2 obtained where the recessed portion 14*bx* is set as the reference recessed portion, and likewise, the distances D1', D2' of the recessed portion 14*by* are distances D1', D2' obtained where the recessed portion 14*by* is set as the reference recessed portion. In FIG. 7, an average value of distances D1, D2 of the recessed portion 14*bx* is less than an average value of distances D1', D2' of the recessed portion 14*by*, and a cross-sectional area of the recessed portion 14*by* is less than a cross-sectional area of the recessed portion 14*bx*.

In the present embodiment, the cross-sectional area of each recessed portion 14*b* is adjusted by an inclination angle (an acute angle) of the side portion (face) of the recessed portion 14*b* with respect to the ejection face 10*a*. Inclination angles of respective opposite side portions of each recessed portion 14*b* in the sub-scanning direction are the same as each other (in FIG. 7, the inclination angles of the respective side portions: θ1=θ2, θ1'=θ2'). Further, in FIG. 7, the inclination angle θ1 (=θ2) of the side portion of the cross section of the recessed portion 14*bx* with respect to the ejection face 10*a* is greater than the inclination angle θ1' (=θ2') of the side portion of the cross section of the recessed portion 14*by* with respect to the ejection face 10*a*. Since the depth of the cross section of the recessed portion 14*bx* (i.e., a length of the cross section of the recessed portion 14*bx* in a direction perpendicular to the main scanning direction and the sub-scanning direction) is the same as the depth of the cross section of the recessed portion 14*by*, the cross-sectional area of the recessed portion 14*bx* is greater than the cross-sectional area of the recessed portion 14*by*.

There will be next explained the size relationship of the cross-sectional areas of the recessed portions 14*b* with reference to FIG. 6.

The ejection openings 14*a* formed in one of the central two recessed portions 14*bx* of each of the recessed-portion groups X2, X3, X4 are adjacent to the ejection openings 14*a* formed in the other of the central two recessed portions 14*bx* at the center-to-center distance of 0.24 mm. Further, the ejection openings 14*a* formed in each of the central two recessed portions 14*bx* are adjacent, at the center-to-center distance of 0.50 mm, to the ejection openings 14*a* formed in a corresponding one of the recessed portions 14*by* which is located outside each of the central two recessed portions 14*bx*. Accordingly, in each of the recessed portions 14*bx*, the average value of these center-to-center distances is 0.37 (0.24+0.50)/2) mm.

The ejection openings 14*a* formed in each of the outer two recessed portions 14*by* of each of the recessed-portion groups X2, X3, X4 are adjacent, at the center-to-center distance of 1.78 mm, to the ejection openings 14*a* formed in a corresponding one of the recessed portions 14*b* which belongs to another recessed-potion group and which is located outside the recessed portion 14*by* without interposing any other recessed portions 14*b*. Further, the ejection openings 14*a* formed in each of the outer two recessed portions 14*by* are adjacent, at the center-to-center distance of 0.50 mm, to the ejection openings 14*a* formed in a corresponding one of the recessed portions 14*bx* of the same recessed-potion group. Accordingly, in each of the recessed portions 14*by*, the average value of these center-to-center distances is 1.14 (=(0.50+1.78)/2) mm.

The ejection openings 14*a* formed in an inner one of the two recessed portions 14*bz* of each of the recessed-portion groups X1, X5 in the sub-scanning direction are adjacent, at the center-to-center distance of 0.75 mm, to the ejection openings 14*a* formed in an outer one of the two recessed portions 14*bz* in the sub-scanning direction. Further, the ejection openings 14*a* formed in the inner one of the two recessed portions 14*bz* are adjacent, at the center-to-center distance of 1.78 mm, to the ejection openings 14*a* formed in a corresponding one of the recessed portions 14*b* which belongs to another recessed-potion group and which is located inside the recessed portion 14*bz* without interposing any other recessed portions 14*b*. Accordingly, in each of the inner recessed portions 14*bz*, the average value of these center-to-center distances is 1.265 (=(0.75+1.78)/2) mm.

The ejection openings 14*a* formed in the outer one of the two recessed portions 14*bz* of each of the recessed-portion groups X1, X5 in the sub-scanning direction are adjacent, at the center-to-center distance of 0.75 mm, to the ejection openings 14*a* formed in the inner one of the two recessed portions 14*bz*. Further, the ejection openings 14*a* formed in the outer one of the two recessed portions 14*bz* are adjacent to the end portion 10*a*1 or 10*a*2 at the distance of Y1 or Y2 mm. Accordingly, in each of the outer recessed portions 14*bz*, where the distance Y1 or Y2 is set as the center-to-center distance, the average value of these center-to-center distances is ((0.75+Y1 or Y2)/2) mm.

Because of the relationship of 1.78<Y1<Y2, the average values of the center-to-center distances are as follows in order from the largest one: the outer recessed portion 14*bz* of the recessed-portion group X5; the outer recessed portion 14*bz* of the recessed-portion group X1; the inner recessed portion 14*bz* of each of the recessed-portion groups X1, X5; the recessed portions 14*by* of the recessed-portion groups X2, X3, X4; and the recessed portions 14*bx* of the recessed-portion groups X2, X3, X4. The relationship of each average value of the above-described center-to-center distances is the same as the relationship of the average value of the distances D1, D2 (see FIG. 7). Thus, the average values of the distances D1 and D2 are as follows in order from the largest one: the outer recessed portion 14*bz* of the recessed-portion group X5; the outer recessed portion 14*bz* of the recessed-portion group X1; the inner recessed portions 14*bz* of the recessed-portion groups X1, X5; the recessed portions 14*by* of the recessed-portion groups X2, X3, X4; and the recessed portions 14*bx* of the recessed-portion group X2, X3, X4. The relationship of the cross-sectional areas of the recessed portions 14*b* is reverse to the relationship of the average value of the distances D1, D2 and is as follows in order from the smallest one: the outer recessed portion 14*bz* of the recessed-portion group X5; the outer recessed portion 14*bz* of the recessed-portion group X1; the inner recessed portions 14*bz* of the recessed-portion groups X1, X5; the recessed portions 14*by* of the recessed-portion groups X2, X3, X4; and the recessed portions 14*bx* of the recessed-portion groups X2, X3, X4.

It is noted that where the distances D1, D2 of the recessed portion 14*b* are equal to or greater than a predetermined value, variation or unevenness in a pressure applied to the ejection face 10*a* by components such as a wiper and a mask 80, and an amount of entering (entering amount) of these components into the recessed portions 14*b* substantially disappears. Thus, where the cross-sectional area is determined only based on the average value of the distances D1, D2, there is a risk of underestimating an effect of the distances D1, D2 on the above-described pressure and the entering amount. Thus, where one of the distances D1, D2 of the recessed portion 14*b* is equal to or larger than the predetermined value, only the other distance (that is smaller than the predetermined value) is used instead of the average value of the above-described distances. Specific explanation is given below. It is noted that the following explanation is provided, focusing the above-described center-to-center distances instead of the distances D1, D2. That is, where one of two center-to-center distances of the recessed portion 14*b* (that is, the center-to-center distances on the one side and the other side in the sub-scanning direction) is equal to or larger than the predetermined value, the other center-to-center distance (that is smaller than the predetermined value) is used instead of the average value of the center-to-center distances.

In the outer recessed portion 14*bz* of the recessed-portion group X5, the outer recessed portion 14*bz* of the recessed-portion group X1, the inner recessed portions 14*bz* of the recessed-portion groups X1, X5, the recessed portions 14*by* of the recessed-portion groups X2, X3, X4, and the recessed portions 14*bx* of the recessed-portion groups X2, X3, X4, the average values of the above-described center-to-center distances are ((0.75+Y2)/2) mm, ((0.75+Y1)/2) mm, 1.265 (0.75+1.78)/2) mm, 1.14 (=(0.50+1.78)12) mm, and 0.37

(=(0.24+0.50)2) mm, respectively, but the following changes are made. That is, where the predetermined value of the center-to-center distance is set at 1 mm, distances Y2 and Y1, and 1.78 (mm) are equal to or larger than the predetermined value. Thus, in the outer recessed portion 14*bz* of the recessed-portion group X5, the outer recessed portion 14*bz* of the recessed-portion group X1, the inner recessed portions 14*bz* of the recessed-portion groups X1, X5, the recessed portions 14*by* of the recessed-portion groups X2, X3, X4, and the recessed portions 14*bx* of the recessed-portion groups X2, X3, X4, the average values of the above-described center-to-center distances after the change (the changed average value) are 0.75 mm, 0.75 mm, 0.75 mm, 0.50 mm, and 0.37 mm, respectively.

A large-and-small relationship of the changed average values of the above-described center-to-center distances is the same as a large-and small relationship of the average values of the distances D1, D2 after the change (the changed average values). The size relationship of the cross-sectional areas of the recessed portions 14*b* is reverse to the large-and small relationship of the changed average values of the distances D1, D2. The cross-sectional areas of the recessed portions 14*b* are as follows in order from the largest one; the recessed portions 14*bx* of the recessed-portion groups X2, X3, X4; the recessed portions 14*by* of the recessed-portion groups X2, X3, X4; and the other recessed portions 14*b*.

It is noted that, where both of the distances D1, D2 of the recessed portion 14*b* are equal to or larger than the predetermined value, the cross-sectional area of the recessed portion 14*b* is set at the smallest cross-sectional area among all the recessed portions 14*b*.

Figure 8:
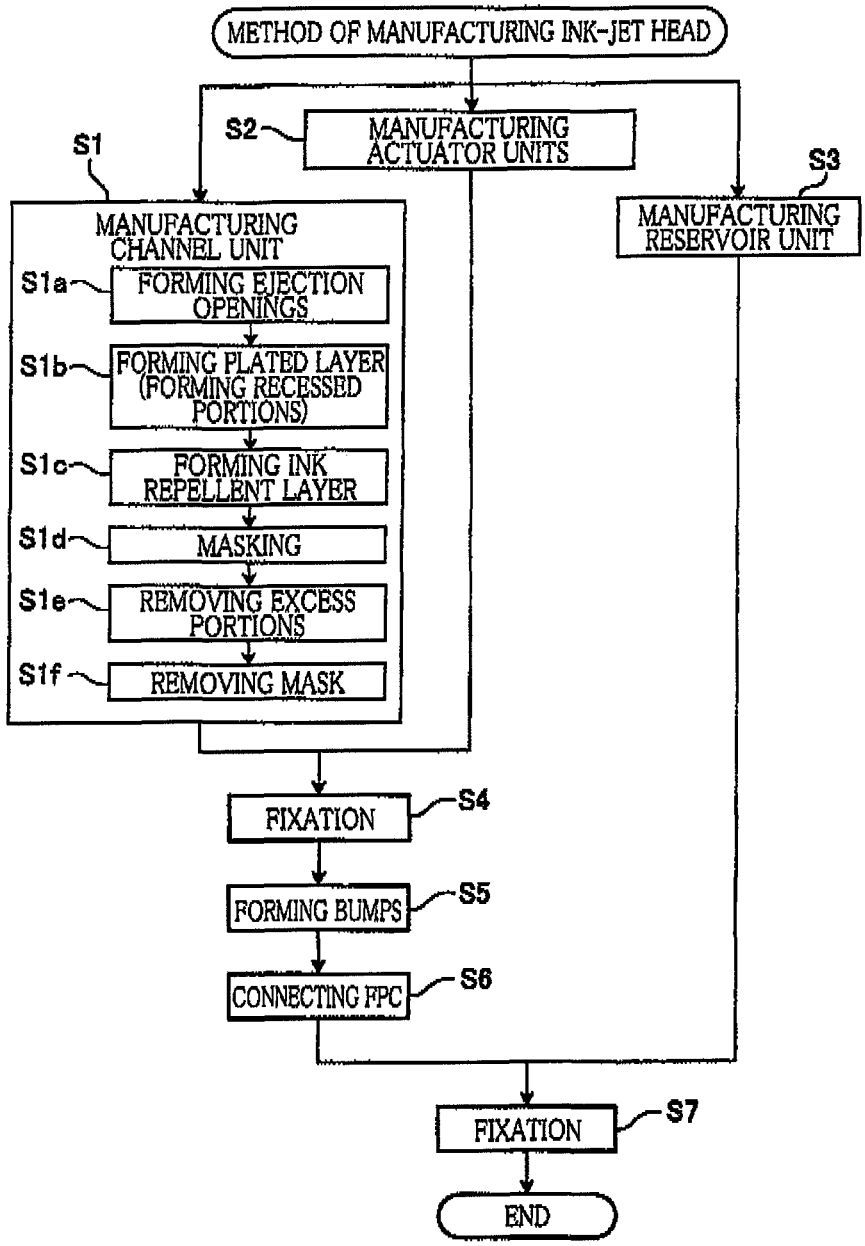
FIG. 8 is a flow-chart showing a method of manufacturing the ink-jet head.
Figure 9A:
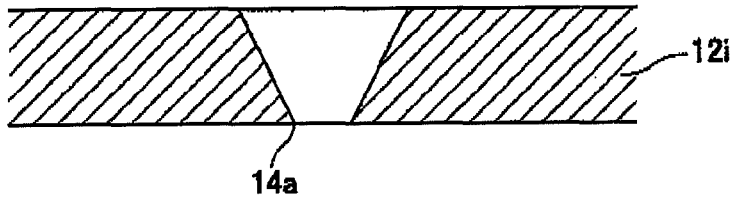
FIGS. 9A-9E are partial cross-sectional views for explaining steps S1*a*-S1*e* in FIG. 8.
Figure 9B:
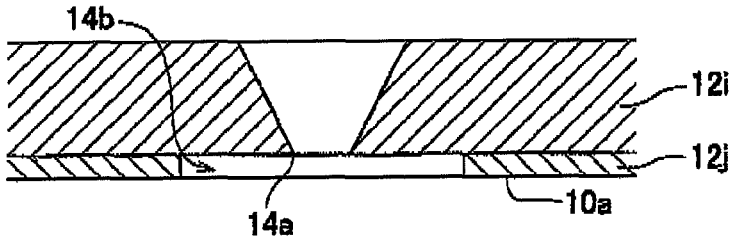
Figure 9C:
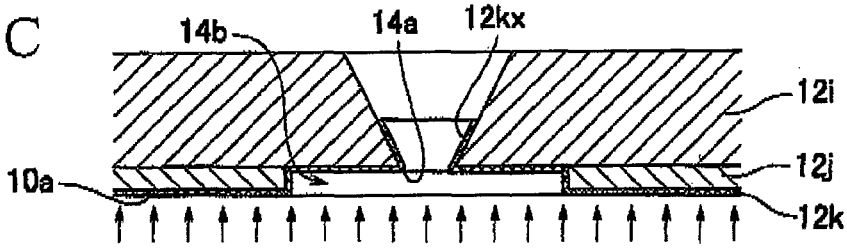
Figure 9D:
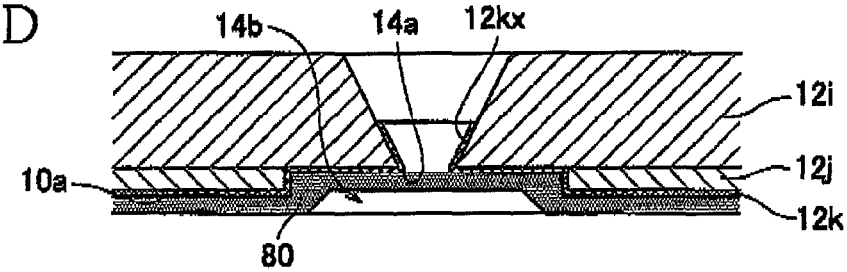
Figure 9E:
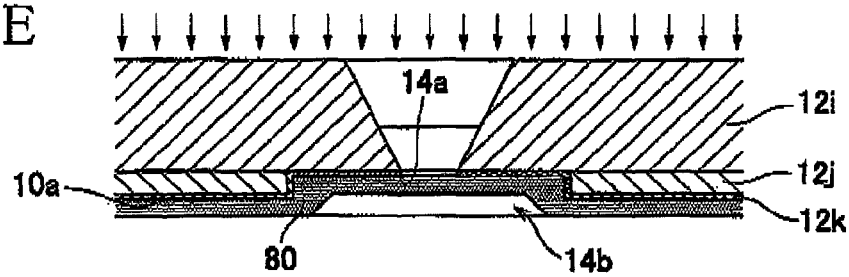
Figure 10:
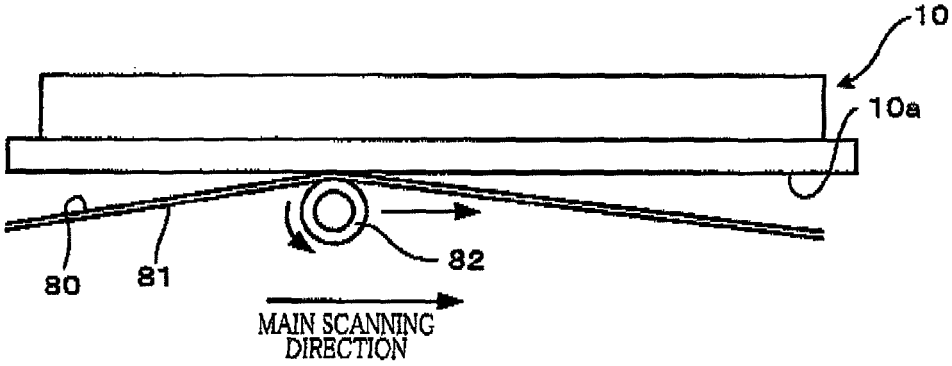
FIG. 10 is a side view for generally explaining a masking step (S1*d* in FIG. 8).

There will be next explained a method of manufacturing the head 10 with reference to FIGS. 8-10.

Initially, the channel unit 12, the actuator units 17, and the reservoir unit 11 are individually manufactured (S1, S2, S3). These processings (steps) S1, S2, S3 are performed independently of one another. Thus, any processing may be performed first, and these processings may be performed in parallel.

In S1, the plates 12*a*-12*i* are prepared by forming the through holes in the nine metal plates. In preparation of the plate 12*i*, through holes each having the ejection opening 14*a* at a distal end thereof are initially formed in the metal plate to be the plate 12*i* using, e.g., a tapered punch (an ejection-opening forming step (processing) S1*a*, see FIG. 9A). Then, a face of the plate 12*i* in which the ejection openings 14*a* are formed is polished to remove burrs formed on a periphery of each ejection opening 14*a*. As a result, the plate 12*i* is completed.

Then, a resist layer is formed, using a photolithography technique, on the face of the plate 12*i* in which the ejection openings 14*a* are formed, except areas to be the recessed portions 14*b*. The plated layer 12*j* is then formed by a nickel electroforming method, with the resist layer used as a mask (a plated-layer forming step (recessed-portion forming step) S1*b*, see FIG. 9B). As a result, the recessed portions 14*b* are formed in the ejection face 10*a*. In this processing, each recessed portion 14*b* is formed so as to have the above-described side portions (see FIG. 7).

Here, the mask is a stacked body constituted by three resist layers. A first layer on the plate 12*i* is exposed to light at areas each corresponding to a width of a lower face of one of the recessed portions 14*b*. Then, a second resist layer is stacked on the first layer. The second layer is exposed to light at areas each having a width slightly larger than a width of a corresponding one of the exposed area of the first layer so as to correspond to the inclination angle of the side portion. An effect of this light exposure is less than that of the light exposure of the first layer. A light exposure is performed on a third layer in a similar manner. That is, the light exposure is performed such that the second layer is in an overhang state with respect to the first layer, and the third layer is in an overhang state with respect to the second layer. Then, portions of the resist layers which have not been exposed to the light are removed by development to form the mask having a shape corresponding to the recessed portions 14*b*. After the nickel electroforming, the mask is removed with removing liquid.

The ink repellent layer 12*k* is then formed on the ejection face 10*a* (an ink-repellent-layer forming step S1*c*, see FIG. 9C). In this processing, an ink repellent agent is applied by spraying to the entire ejection face 10*a* including inner faces of the recessed portions 14*b*, for example, and then a heat treatment is applied to the applied ink repellent agent to form the ink repellent layer 12*k*. In this application, part of the ink repellent agent enters into the ejection openings 14*a*, whereby excess portions 12*kx* are formed on inner portions and peripheries of the ejection openings 14*a*.

Then, the entire-ejection face 10*a* on which the ink repellent layer 12*k* is formed is covered with the mask 80 (a masking step S1*d*, see FIG. 9D). In this processing, as shown in FIG. 10, a tape 81 holding the mask (resist sheet) 80 thereon and a roller 82 for pressing the tape 81 onto the ejection face 10*a* are used, for example. The roller 82 extending in the sub-scanning direction has a length in the sub-scanning direction that is longer than a width of the ejection face 10*a* (i.e., a length thereof in the sub-scanning direction). Initially, the tape 81 is disposed such that a face of the tape faces the ejection face 10*a*, and then the roller 82 is rotated so as to move in the main scanning direction while contacting a back face of the tape 81. A pressure of the pressing of the roller 82 is constant. As a result, the mask 80 is pressed and bonded in order from one to the other end of the ejection face 10*a* in the main scanning direction. Amounts of the mask 80 having entered into the respective recessed portions 14*b* are generally uniform.

Then, the excess portions 12*kx* formed on the inner portions and the peripheries of the ejection openings 14*a* are removed (an excess-portion removing step (processing) S1*e*, see FIG. 9E). In this processing, the excess portions 12*kx* are removed by applying a plasma etching treatment to the plate 12*i* from the face thereof which is opposite to the face thereof having the ejection openings 14*a* opened therein (i.e., from an upper side in FIG. 9E). That is, the plasma etching treatment is applied toward the inner portions of the ejection openings 14*a* from the face of the plate 12*i* which is opposite to the face thereof the mask 80 is bonded.

Then, the mask 80 is removed or stripped from the ejection face 10*a* (a mask removing step S1*f*). Then, the plate 12*i* formed on the plated layer 12*j* and the ink repellent layer 12*k* and the other plates 12*a*-12*h* are stacked on and bonded to one another while being positioned to one another. As a result, the channel unit 12 is completed.

In S2, the eight actuator units 17 are manufactured. In this operation, a metal paste is applied, by screen printing, to a plurality of green sheets each formed of a piezoelectric ceramic material, to form a pattern corresponding to the electrodes, for example. Then, the stacked body of the green sheets is degreased in a manner known in the art of ceramics, and then is fired at an appropriate temperature. As a result, the actuator units 17 are completed.

In S3, the metal plates 11*a*-11*d* are prepared by forming through holes and recessed portions in four metal plates.

These plates 11*a*-11*d* axe stacked on and bonded to one another while being positioned to one another to manufacture the reservoir unit 11.

Then in S4, the eight actuator units 17 manufactured in S2 is fixed to the channel unit 12 manufactured in S1. Then in S5, a metal paste such as solder, silver (Ag), silver palladium (Ag—Pd) is applied to a contact of each of the electrodes formed on the actuator units 17 to form bumps. Then in S6, terminals of the FPCs 50 are respectively connected to the individual electrodes via the bumps formed in S5. Then in S7, the reservoir unit 11 is fixed to the channel unit 12. As a result, each of the openings 12*y* of the manifold channels 13 is connected to a corresponding one of the openings 73*a* of the ink outlet channel 73. Then, the printed circuit 64 is mounted such that the FPCs 50 and the printed circuit 64 are electrically connected to each other via connectors 64*a*, and the side cover 65*b* and the top cover 65*a* are mounted such that the reservoir unit 11 and the actuator units 17 are enclosed with the side cover 65*b*, the top cover 65*a*, and the channel unit 12. As a result, the head 10 is completed.

As explained above, in the head 10 as the present embodiment and the method of manufacturing the head 10, as shown in FIG. 7, the plurality of the recessed portions 14*b* are formed such that the large-and-small relationship of the average value of the distances D1', D2' of the recessed portion 14*by* with respect to the average value of the distances D1, D2 of the recessed portion 14*bx* is the same as the large-and-small relationship of the cross-sectional area of the recessed portion 14*bx* with respect to the cross-sectional area of the recessed portion 14*by*. Thus, it is possible to reduce the variation in the pressure applied to the ejection face 10*a* by the components such as the wiper and the mask 80.

The average value of the distances D1, D2 of the recessed portion 14*bx* is smaller than the average value of the distances D1', D2' of the recessed portion 14*by*, and the cross-sectional area of the recessed portion 14*bx* is larger than the cross-sectional area of the recessed portion 14*by*. The smaller the average value of the distances D1, D2 (D1', D2'), the higher the pressure applied to the recessed portion 14*b* from the components. In the present embodiment, the cross-sectional area is adjusted on the basis of the relationship of the average value of the distances D1, D2 (D1', D2'), making it possible to reduce the variation in the pressure applied to the ejection face 10*a* by the components.

As shown in FIG. 6, in each of the plurality of the recessed portions 14*b*, the plurality of the ejection openings 14*a* are open in the bottom portion 14*b*3. Where a single ejection opening 14*a* is formed in a single recessed portion 14*b*, a relatively large number of the recessed portions 14*b* are required, which complicates the forming operation of the recessed portions 14*b*. However, in the present embodiment, it is possible to reduce the number of the recessed portions 14*b* and facilitate forming the recessed portions 14*b*.

As shown in FIG. 7, the ink repellent layer 12*k* is formed on the entire ejection face 10*a* including its portions defining the recessed portions 14*b*. Thus, the ink repellent layer 12*k* can be easily formed as compared with a case where the ink repellent layer 12*k* is formed on only peripheries of the ejection openings 14*a*.

The recessed portions 14*b* are defined by the plate 12*i* and the plated layer 12*j*. Thus, the recessed portions 14*b* can be formed accurately and easily as compared with in a case where the recessed portions 14*b* are formed in the plate 12*i* by etching, for example.

The recessed portions 14*bx*, 14*by* are different from each other in the shape of the cross section. The recessed portions 14*bx*, 14*by* are the same as each other in the distance between the opposite ends of the opening but different front each other in the inclination angle of the side portion (in FIG. 7, the inclination angle of the side portion: θ1=θ2>θ1'=θ2'). Thus, the cross-sectional area can be easily adjusted.

In the excess-portion removing step S1*e* (see FIG. 9E), the excess portions 12*kx* are removed from the face thereof which is opposite to the face thereof having the ejection openings 14*a* opened therein (i.e., front the upper side in FIG. 9E). Thus, the excess portions 12*kx* can be removed accurately and easily.

There will be next explained ink-jet heads each as a second embodiment of the present invention. The second embodiment is different from the first embodiment in that the depths of the recessed portions 14*bx*, 14*by* are different from each other instead of their shapes and in that the plated layer 12*j* is formed by the nickel vapor deposition instead of the nickel electroforming in the plated-layer forming step S1*b* (see FIG. 9B). The other constructions of this second embodiment are the same as those of the first embodiment.

In this second embodiment, a depth of the recessed portion 14*bx* whose average value of the distances D1, D2 (D1', D2') is relatively small in FIG. 7 is made greater than a depth of the recessed portion 14*by* whose average value of the distances D1, D2 (D1', D2') is relatively large. As a result, the cross-sectional area of the recessed portion 14*bx* becomes larger than the cross-sectional area of the recessed portion 14*by*. It is noted that, in the second embodiment, the inclination angles of the side portions of the recessed portions 14*bx*, 14*by* are the same as each other (in FIG. 7, the inclination angles of the side portions: θ1=θ2=θ1'=θ2'=generally 90 degrees).

In order to adjust the depths of the recessed portions 14*b*, the thickness of the plated layer 12*j* is adjusted. Specifically, in the plated-layer forming step S1*b*, the vapor deposition is performed in twice. In a first time, the vapor deposition is performed on the entire the ejection face 10*a* except all the recessed portions 14*b*. As a result, the recessed portions 14*by* are formed. In a second time, the vapor deposition is performed on peripheries of the recessed portions 14*bx* on the ejection face 10*a* (for example, only on areas along the opening ends 14*b*1,14*b*2 of each recessed portion 14*bx*). As a result, the recessed portions 14*bx* are formed. The recessed portions 14*b* are formed stepwise as thus explained.

In this second embodiment, since the depths of the recessed portions 14*b* are different from each other, the cross-sectional areas can be adjusted in addition to the effects obtained by the same constructions of the first embodiment.

There will be next explained ink-jet heads each as a third embodiment of the present invention. The third embodiment is different from the first embodiment in that inclination angles of respective opposite side portions of a single recessed portion 14*b* in the sub-scanning direction are different from each other. The other constructions of this third embodiment are the same as those of the first embodiment.

In the first embodiment, the inclination angles of the respective opposite side portions of each recessed portion 14*b* in the sub-scanning direction are the same as each other (in FIG. 7, the inclination angles of the side portions: θ1=θ2, θ1'=θ2'), but in this third embodiment, the inclination angle of each side portion of the single recessed portion 14*b* in the sub-scanning direction corresponds to a distance between the recessed portion and another recessed portion 14*b* that is adjacent to the side portion. Specifically, in the third embodiment, where the distances D1, D2 (D1', D2') are different from each other, the inclination angle of the side portion located on a smaller-distance side is made larger than the inclination angle of the side portion located on a larger-distance side. For example, in the case of the second recessed portion 14*bx* from the right side in FIG. 7, the inclination angle θ2 of the side portion on the smaller-distance side (the right inclination angle in FIG. 7) is made larger than the inclination angle θ1 of the side portion on the larger-distance side (the left inclination angle in FIG. 7) (θ1<θ2). Likewise, in the case of the third recessed portion 14*by* from the right side in FIG. 7, the inclination angle θ2' of the side portion on the smaller-distance side (the right inclination angle in FIG. 7) is made larger than the inclination angle θ1' of the side portion on the larger-distance side (the left inclination angle in FIG. 7) (θ1'<θ2'). Further, in correspondence with the large-and-small relationship of the cross-sectional areas, the inclination angles are made θ1>θ1', θ2≥θ2'.

In each recessed portion 14*b*, a higher pressure tends to be applied from the components to one of the opening ends 14*b*1, 14*b*2 that is located on the smaller-distance side (corresponding to a smaller one of the distances D1, D2 (D1', D2')), whereby an entering amount of the components into the recessed portion 14*b* becomes large. Thus, in this third embodiment, since the inclination angle of the side portion θ1, θ1' on the large-distance side is made relatively small, even where the pressure from the components varies on the opposite portions of the recessed portion 14*b*, the entering amount of the components into the recessed portion 14*b* can be made uniform.

While the embodiments of the present invention has been described above, it is to be understood that the invention is not limited to the details of the illustrated embodiments, but may be embodied with various changes and modifications, which may occur to those skilled in the art, without departing from the spirit and scope of the invention.

The cross-sectional areas of the first and second recessed portions 14*bx*, 14*by* may be the same as each other where the average values of the distances D1, D2 are the same as each other. In this ease, the large-and-small relationship of the cross-sectional areas of the first and second recessed portions 14*bx* and 14*by* (i.e., the relationship in which the cross-sectional areas are the same as each other) is the same as the large-and-small relationship of the average values of the distances D1, D2 of the first and second recessed portions 14*bx* and 14*by* (i.e., the relationship in which the average values of the distances are the same as each other). Thus, in the first embodiment, for any two recessed portions 14*b* of all the recessed portions 14*b*, the large-and-small relationship of the cross-sectional areas of the two recessed portions is the same as the large-and-small relationship of the average values of the distances D1, D2 of the two recessed portions. However, all of the recessed portions 14*b* do not need to satisfy the condition explained above. That is, for all the recessed portions 14*b*, the relationship of the average value of the distance D1' and the distance D2' of each second recessed portion 14*by* with respect to the relationship of the average value of the distance D1 and the distance D2 of the corresponding first recessed portion 14*bx* is not necessarily the same as the relationship of the cross-sectional area of the first recessed portion 14*bx* with respect to the cross-sectional area of the second recessed portion 14*by*. In other words, for a part of the recessed portions 14*b*, the above-described relationships may be the same as each other.

The second recessed portions 14*by* include the recessed portions each having the bottom portion not having the ejection openings opened therein in addition to the recessed portions each having the bottom portion having the ejection openings opened therein.

The first recessed portions 14*bx* may be different from the second recessed portions 14*by* in both of the depth and the shape of the side portions. The inclination angle of each side portion of the recessed portions with respect to the ejection face may be any angle. The side portion of the recessed portion may be rounded. The depth of the recessed portion and the shape of the side portion may be adjusted by a length of time and/or the number of the plating in the plated-layer forming step, a plating method, and/or the like.

The plated layer is not limited to be formed by the electroforming and the vapor deposition and may be formed by various methods. The recessed portions are not limited to be defined by a base member and the plated layer and may be formed by processing the base member using etching, for example. Further, the base member is not limited to have a plate-like shape.

Where the recessed portion has the elongated shape as seen from a direction perpendicular to the ejection face, the recessed portion may extend in any direction parallel to the ejection face. Further, the plurality of the elongated recessed portions may be different from one another in their extending directions. Widths of the respective elongated recessed portions may not be the same as one another. Further, the width of each recessed portion may not be constant in its longitudinal direction and may be changed. The shape of each recessed portion as seen from the direction perpendicular to the ejection face is not limited to the elongated shape and may be a round shape or a square, for example. Further, each recessed portion is not limited to have the plurality of the ejection openings and may have a single ejection opening.

The liquid repellent layer is not limited to be formed on the entire ejection face including portions thereof defining the recessed portions and may be formed on any area as long as the liquid repellent layer is formed on at least the bottom portion of each recessed portion.

Any component and method may be employed as the component used in the masking step and the method of pressing and bonding the mask onto the ejection face. For example, in the above-described embodiment, the head 10 may be moved in the main scanning direction in a state in which the roller 82 shown in FIG. 10 is fixed. Further, a roller extending in the main scanning direction may be used to press and bond the mask onto the ejection face from one end to the other thereof in the sub-scanning direction in order. Further, instead of the roller 82, a flat plate that is one size larger than the ejection face 10*a* may be used to press the tape 81 onto the ejection face 10*a*. In this case, the flat plate contacts with the back face of the tape 81, and the entire ejection face 10*a* is covered with the mask 80 at one time.

The liquid ejection head to which the present invention is applied is not limited to be employed for the printer, and the present invention may be applied to a liquid ejection apparatus such as a facsimile machine and a copying machine. Further, the number of the liquid ejection heads used for the liquid ejection apparatus is not limited to four and may be any number as long as the number is not less than one. Further, in the above-described embodiment, the actuator using the piezoelectric elements is employed as an actuator (an ejection-energy generating portion) configured to apply an energy for ejecting liquid, but an actuator of another type may be used such as a thermal type using heating elements, electrostatic type using an electrostatic force, and the like, for example. The liquid ejection head is not limited to the line head and may be a serial head. Further, the liquid ejection head to which the present invention is applied may be configured to eject liquid other than the ink.

What is claimed is:

1. A liquid ejection head, comprising:

an ejection face having a plurality of recessed portions formed therein, wherein the plurality of the recessed portions include:

a first recessed portion having a bottom portion in which at least one ejection opening is formed for ejecting liquid and on which a liquid repellent layer is formed; and a second recessed portion having an opening end whose length in one direction parallel to the ejection face is the same as a length of an opening end of the first recessed portion in the one direction, and wherein the plurality of the recessed portions are formed such that, where a distance D1 is a distance between (i) a one-side portion of an opening end of one recessed portion of the plurality of the recessed portions in the one direction and (ii) an other-side portion of an opening end of another recessed portion, in the one direction, adjacent to the one recessed portion on one side of the one recessed portion in the one direction without interposing any recessed portions between said another recessed portion and the one recessed portion and where a distance D2 is a distance between (i) an other-side portion of the opening end of the one recessed portion in the one direction and (ii) a one-side portion of an opening end of another recessed portion, in the one direction, adjacent to the one recessed portion on the other side of the one recessed portion in the one direction without interposing any recessed portions between said another recessed portion and the one recessed portion, a large-and-small relationship of an average value of the distance D1 and the distance D2 of the second recessed portion with respect to an average value of the distance D1 and the distance D2 of the first recessed portion is the same as a large-and-small relationship of an area of a cross section of the first recessed portion which cross section is perpendicular to the ejection face and along the one direction, with respect to an area of a cross section of the second recessed portion which cross section is perpendicular to the ejection face and along the one direction.

2. The liquid ejection head according to claim 1, wherein, where there is no recessed portion on the one side of the one recessed portion, a distance between the one-side portion of the opening end and a one-side end portion of the ejection face in the one direction is set as the distance D1, and wherein, where there is no recessed portion on the other side of the one recessed portion, a distance between the other-side portion of the opening end and the other-side end portion of the ejection face in the one direction is set as the distance D2.

3. The liquid ejection head according to claim 2, wherein all of the plurality of the recessed portions are formed such that the large-and-small relationship of the average value of the distances D1 and D2 of the second recessed portion with respect to the average value of the distances D1 and D2 of the first recessed portion is the same as the large-and-small relationship of the area of the cross section of the first recessed portion with respect to the area of the cross section of the second recessed portion.

4. The liquid ejection head according to claim 1, wherein the average value of the distances D1 and D2 of the first recessed portion is different from the average value of the distances D1 and D2 of the second recessed portion, wherein, where the average value of the distances D1 and D2 of the first recessed portion is smaller than the average value of the distances D1 and D2 of the second recessed portion, the area of the cross section of the first recessed portion is larger than the area of the cross section of the second recessed portion, and wherein, where the average value of the distances D1 and D2 of the first recessed portion is larger than the average value of the distances D1 and D2 of the second recessed portion, the area of the cross section of the first recessed portion is smaller than the area of the cross section of the second recessed portion.

5. The liquid ejection head according to claim 1, wherein the plurality of the recessed portions are distant from each other in the one direction and each extends in a direction intersecting the one direction, and wherein each of the plurality of the recessed portions has a plurality of the ejection openings opening in the bottom portion.

6. The liquid ejection head according to claim 1, wherein the liquid repellent layer is formed on an entirety of the ejection face including portions thereof defining the first recessed portion.

7. The liquid ejection head according to claim 1, wherein the first recessed portion is defined by (i) a base member having the at least one ejection opening formed in a face of the base member and (ii) a plated layer formed on the face of the base member except the at least one ejection opening and an area therearound.

8. The liquid ejection head according to claim 1, wherein the first recessed portion is different from the second recessed portion in at least one of a depth of the first recessed portion and a shape of side faces defining the first recessed portion with the ejection face.

9. The liquid ejection head according to claim 8, wherein, in the cross section perpendicular to the ejection face and along the one direction, an inclination angle of one of the side faces with respect to the ejection face, which one is located nearer to a side corresponding to a larger one of the distance D1 and the distance D2 of the first recessed portion is smaller than an inclination angle of the other of the side faces with respect to the ejection face, which other is located nearer to a side corresponding to a smaller one of the distance D1 and the distance D2 of the first recessed portion.

10. A method of manufacturing a liquid ejection head having an ejection f ace that has a plurality of recessed portions formed therein, the method comprising:

a recessed-portion forming step of forming the plurality of the recessed portions including: a first recessed portion having a bottom portion in which at least one ejection opening is formed for ejecting liquid; and a second recessed portion having an opening end whose length in one direction parallel to the ejection face is the same as a length of an opening end of the first recessed portion in the one direction;

a liquid-repellent-layer forming step of forming a liquid repellent layer on the bottom portion of the formed first recessed portion;

a masking step of covering, with a mask, a portion of the ejection face on which the liquid repellent layer is formed, the portion including the at least one ejection opening;

an excess-portion removing step of removing an excess portion of the formed liquid repellent layer after the masking step, the excess portion being formed in the at least one ejection opening; and a mask removing step of removing the mask from the ejection face after the excess-portion removing step, wherein the recessed-portion forming step is a step of forming the plurality of the recessed portions such that, where a distance Dl is a distance between (i) a one-side portion of an opening end of one recessed portion of the plurality of the recessed portions in the one direction and (ii) an other-side portion of an opening end of another recessed portion, in the one direction, adjacent to the one recessed portion on one side of the one recessed portion in the one direction without interposing any recessed portions between said another recessed portion and the one recessed portion and where a distance D2 is a distance between (i) an other-side portion of the opening end of the one recessed portion in the one direction and (ii) a one-side portion of an opening end of another recessed portion, in the one direction, adjacent to the one recessed portion on the other side of the one recessed portion in the one direction without interposing any recessed portions between said another recessed portion and the one recessed portion, a large-and-small relationship of an average value of the distance D1 and the distance D2 of the second recessed portion with respect to an average value of the distance D1 and the distance D2 of the first recessed portion is the same as a large-and-small relationship of an area of a cross section of the first recessed portion which cross section is perpendicular to the ejection face and along the one direction, with respect to an area of a cross section of the second recessed portion which cross section is perpendicular to the ejection face and along the one direction.

11. The method of manufacturing the liquid ejection head according to claim 10, wherein, where there is no recessed portion on the one side of the one recessed portion, a distance between the one-side portion of the opening end and a one-side end portion of the ejection face in the one direction is set as the distance D1, and wherein, where there is no recessed portion on the other side of the one recessed portion, a distance between the other-side portion of the opening end and the other-side end portion of the ejection face in the one direction is set as the distance D2.

12. The method of manufacturing the liquid ejection head according to claim 11, wherein the recessed-portion forming step is a step of forming the plurality of the recessed portions such that, for all the recessed portions, the large-and-small relationship of the average value of the distances D1 and D2 of the second recessed portion with respect to the average value of the distances D1 and D2 of the first recessed portion is the same as the large-and-small relationship of the area of the cross section of the first recessed portion with respect to the area of the cross section of the second recessed portion.

13. The method of manufacturing the liquid ejection head according to claim 10, wherein the recessed-portion forming step is a step of forming the plurality of the recessed portions such that, where the average value of the distances D1 and D2 of the first recessed portion is smaller than the average value of the distances D1 and D2 of the second recessed portion, the area of the cross section of the first recessed portion is larger than the area of the cross section of the second recessed portion, and such that, where the average value of the distances D1 and D2 of the first recessed portion is larger than the average value of the distances D1 and D2 of the second recessed portion, the area of the cross section of the first recessed portion is smaller than the area of the cross section of the second recessed portion.

14. The method of manufacturing the liquid ejection head according to claim 10, wherein the recessed-portion forming step is a step of forming the plurality of the recessed portions such that the plurality of the recessed portions are distant from each other in the one direction and each extends in a direction intersecting the one direction, and such that each of the plurality of the recessed portions has the at least one ejection opening in the bottom portion.

15. The method of manufacturing the liquid ejection head according to claim 10, wherein the liquid-repellent-layer forming step is a step of forming the liquid repellent layer on an entirety of the ejection face including portions thereof defining the first recessed portion.

16. The method of manufacturing the liquid ejection head according to claim 10, wherein the recessed-portion forming step is a step of forming the first recessed portion by forming (i) a base member having the at least one ejection opening formed in a face of the base member and (ii) a plated layer on the face of the base member except the at least one ejection opening and an area therearound.

17. The method of manufacturing the liquid ejection head according to claim 10, further comprising an ejection-opening forming step of forming the at least one ejection opening in the ejection face by forming a through hole in a plate member constituting a part of the liquid ejection head, wherein, in the excess-portion removing step, the excess portion is removed from a face of the plate member which is opposite to a face thereof in which the at least one ejection opening is formed.

18. The method of manufacturing the liquid ejection head according to claim 10, wherein the recessed-portion forming step is a step of forming the first recessed portion such that the first recessed portion is different from the second recessed portion in at least one of a depth of the first recessed portion and a shape of side faces defining the first recessed portion with the ejection face.

19. The method of manufacturing the liquid ejection head according to claim 10, wherein the recessed-portion forming step is a step of forming the first recessed portion such that, in the cross section perpendicular to the ejection face and along the one direction, an inclination angle of one of the side faces with respect to the ejection face, which one is located nearer to a side corresponding to a larger one of the distance D1 and the distance D2 of the first recessed portion is smaller than an inclination angle of the other of the side faces with respect to the ejection face, which other is located nearer to a side corresponding to a smaller one of the distance D1 and the distance D2 of the first recessed portion.

* * * * *